US005192158A

United States Patent [19]

Bailey et al.

[11] Patent Number: 5,192,158

[45] Date of Patent: Mar. 9, 1993

[54] APPARATUS FOR CONTROLLING THE DIRECTION OF VEHICULAR TRAFFIC MOVEMENT

[75] Inventors: Richard E. Bailey, Gilbert; Clarence G. Austin, Scottsdale, both of Ariz.

[73] Assignee: Park N' Shade, Phoenix, Ariz.

[21] Appl. No.: 667,458

[22] Filed: Mar. 11, 1991

[51] Int. Cl.[5] ..... E01F 9/00; E01F 13/00

[52] U.S. Cl. ..... 404/11; 49/49

[58] Field of Search ..... 404/6, 9-11; 49/49

[56] References Cited

U.S. PATENT DOCUMENTS

| | | | |
|---|---|---|---|
| 1,563,637 | 12/1925 | Lundbald | 49/49 |
| 3,783,558 | 1/1974 | Keator | 49/49 |
| 4,158,514 | 6/1979 | Dickinson | 404/6 |
| 4,325,651 | 4/1982 | Szegi | 49/49 X |

FOREIGN PATENT DOCUMENTS

| | | | |
|---|---|---|---|
| 2522036 | 2/1983 | France | 49/49 |

*Primary Examiner*—Ramon S. Britts
*Assistant Examiner*—Nancy Connolly
*Attorney, Agent, or Firm*—Joseph H. Roediger

[57] ABSTRACT

Apparatus for controlling the direction of traffic flow wherein a plurality of rotationally mounted levers have a free end extending upwardly from the road surface. The levers are provided with removable spikes which rotate therewith to damage tires when the levers are rotated in one direction. The free end of each lever is provided with a rotationally mounted low friction contact member which contacts the adjacent surface of the tire and moves along the surface thereof. Envelopment of the free end of the lever by the tire and the coerced rotation thereof in the wrong direction do not occur. As a result, the failure of the corresponding spike to damage a tire when the vehicle is moving in the wrong direction is thereby avoided.

12 Claims, 1 Drawing Sheet

APPARATUS FOR CONTROLLING THE DIRECTION OF VEHICULAR TRAFFIC MOVEMENT

BACKGROUND

This invention relates to apparatus for controlling the direction of vehicular traffic flow so as to inhibit wrong way traffic or motor vehicles at designated locations.

The control of traffic flow in particular areas is necessary to ensure continuous traffic movement and to prevent unauthorized use of certain rights of way. At present, it is common to use a visual warning coupled with a road-mounted barrier that is routinely deflected by the wheels of a motor vehicle when the vehicle is traveling in the permitted direction. Typically, this is brought about by the use of rotationally mounted levers extending upwardly from beneath the road surface. When a vehicle tire contacts one or more of the levers, they are readily moved to a position below the road surface so as to permit authorized traffic flow.

In the case of traffic flow in the unauthorized direction, the device customarily contains tire damaging means which are preferably actuated by the vehicle tire rather than being motor driven. The tire damage leaves a lasting impression, not only on the driver of the vehicle moving in the non-permitted direction, but also on passengers, onlookers and the community at large. Thus, observation of effective operation and word of mouth play major roles in the device's effectiveness. The efficacy of devices of this type rely on the piercing of or shredding of a vehicle tire that has entered the designated area and then attempts to move through or across it contrary to the warning signs. The vehicle tire contacts the lever causing a normally retracted or hidden damage mechanism to appear and produce its designed-for effect. To the extent that vehicular traffic can be carried out in the non-permitted direction without causing damage, the device not only fails on this particular occasion, but also fails to provide the desired notice to the community that undesirable consequences will occur if the signage and other traffic flow indicators are not obeyed.

One traffic flow regulating device is disclosed in U.S. Pat. No. 4,158,514 wherein each upwardly extending lever is made integral with a barrier blade. The blade assumes a normally retracted position below the surface. When the tire of a vehicle traveling in the non-permitted direction engages the free end of an upwardly extending lever arm, it is expected that the lever will be depressed in the direction of the traffic flow and urge the associated blade up against the tire so as to produce a shredding effect. In the permitted direction, the levers are contacted by the tire and the blades are rotated in the opposing direction so that they never appear above surface and do not constitute a hazard during normal use. The device is preferably constructed so that the axis of the lever and that of the associated blade form an angle of the order of 90 degrees that the blade does not emerge accidentally during traffic movement in the permitted direction.

While this device may be effective in the case of solid vehicle tires or highly pressurized tires, the present day passenger vehicle is usually provided with relatively low pressure tires characterized by a wide tread. Consequently, it has been found that many tires in general use tend to frictionally engage and envelop the free end of the lever. As a result, the tire surrounds the adjacent portion of the lever and urges it backward in the direction of rotation of the tire. This direction is contrary to the direction of movement of the vehicle and corresponds to the permitted direction of traffic flow across the apparatus. The frequent result is that the device does not operate as intended and no damage to the vehicle tire takes place.

Accordingly, the present invention is directed to the provision of a vehicular traffic controller wherein the tendency of the vehicle tire to frictionally engage or envelop the lever arms is substantially eliminated. The ability to inhibit this envelopment results in increased operating reliability in that the spike associated with each lever arm is able to emerge from its retracted position and engage the tire. Thus, the present invention is constructed to produce the desired result of tire damage when the device is traversed by a vehicle moving in the non-permitted direction.

SUMMARY OF THE INVENTION

This invention relates to an improved traffic controller for allowing vehicular traffic flow in a permitted direction while inhibiting flow in an opposing direction. The apparatus includes a planar member which supports motor vehicles traveling thereacross. The planar member is provided with a plurality of openings spaced thereacross, each opening positioned in general alignment with the expected direction of traffic flow.

A plurality of actuating levers extend upwardly through the corresponding openings in the planar member and are positioned to contact a vehicle tire when it passes across the planar member. Beneath the planar member is located coupling means for rotationally mounting the levers to permit movement thereof in alignment with the expected traffic pattern. The levers are rotated to a position beneath the planar member when contacted by the vehicle tire traversing the planar member. A low friction contact member is affixed to the free end of each of the levers. The members contact the vehicle tire, reduce the frictional engagement therewith and move along the surface of the tire thereby avoiding rotation of the lever in the wrong direction. Removable piercing members are operatively connected to each of the actuating levers and are positioned beneath the planar member during periods of non-use.

In operation, the vehicle tire moves against the contacting members which are rotationally mounted on the lever ends and these members move along the adjacent surface of the tire in the direction of the vehicle movement, not in the direction of rotation of the tire. As a result, a piercing member rotates with its corresponding lever to engage the tire when the vehicle is moving in the non-permitted direction. When the vehicle is moving in the permitted direction, the vehicle tire moves against the contact members and thereby urges the end of the lever to a position beneath the planar member. The corresponding piercing member does not emerge from beneath the planar member in this circumstance.

Since the free end of each lever arm is provided with a rotationally mounted means for contacting the adjacent surface of the tire, the ability of a tire to envelop the lever arm and urge it to rotate therewith is essentially eliminated. In effect, the vehicle tire does not surround and fictionally engage the free end of the lever, but pushes it in the direction opposite to the direction of rotation of the vehicle tire. The piercing member then is free to emerge and damage the tire.

Consequently, the device functions in its designed-for manner and the reliability of operation causes the warnings and signage at the location to be taken seriously.

Further features and advantages of the invention will become more readily apparent from the following detailed description of a preferred embodiment when taken in conjunction with the accompanying drawings.

DESCRIPTION OF THE PREFERRED EMBODIMENT

Figure 1:
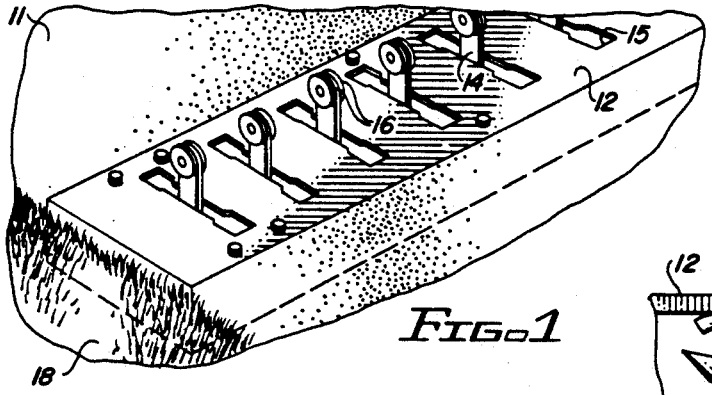
FIG. 1 is a partial view in perspective of one embodiment of the invention.

Referring now to FIG. 1, planar plate 12 is shown emplaced in road surface 11. A grass verge 18 is shown bordering the road surface. A generally rectangular container is shown beneath the plate 12 by dashed lines to illustrate that clearance is needed between the portion of the invention residing beneath the plate 12 and the surrounding materials. The actual shape or dimensions of any container used may vary as needed.

The plate 12 is shown containing a plurality of openings spaced transversely across the plate so as to cover that portion of the roadway upon which the vehicular traffic is to be controlled. The objective of the invention is to permit unimpeded traffic flow in a single direction and to reliably inhibit flow in an opposing direction by use of a plurality of lever arms 14 extending upwardly from the top surface of plate 12. The openings are shown in the form of slots having opposing terminal portions of expanded width. When a vehicle travels in either direction, its tires first contact the disks 16 mounted on the exposed ends of lever arms 14 and urge the levers beneath the top surface of plate 12. Consequently, expanded area terminal portions of slots 15 are shown so as to accommodate the disks on the lever arms so they move beneath the plate 12.

Figure 2:
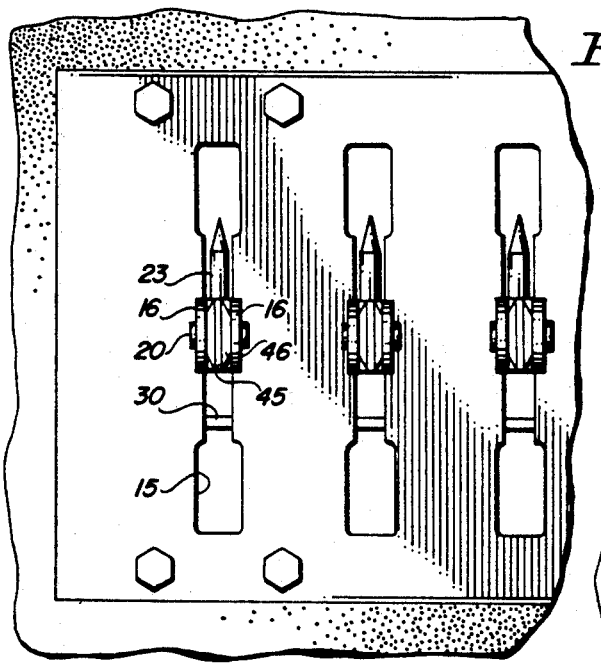
FIG. 2 is a top view of a portion of the embodiment shown in FIG. 1.

In FIG. 2, a partial top view of the assembly of FIG. 1 shows the three end lever arms 14 and that portion of the mechanism visable from the top surface of plate 12. In particular, a piercing member or spike 23 is shown beneath the plate and positioned to contact a vehicle tire when the lever arm is moved in the non-permitted direction. When the vehicle is moving in the permitted direction, the lever is urged by the tire to rotate so as to move to a position beneath the surface of plate 12. The piercing member 23 is operatively connected thereto so as to rotate away from the plate and thus not contact the tire. The top section of the lever arm 14 is shown having a tapered edge portion 46 on either side of the central section 45. Disks 16 are mounted on either side of the free end of the lever arm 14. The disks are mounted on the opposing ends of axle 20 which extends through the corresponding end of a lever arm so as to permit rotation of the disks.

When a vehicle tire engages the free end of the lever arm and the disks mounted thereon, the disks are free to rotate and travel along the surface of the tire while still bearing a portion of the weight of the vehicle. Thus, the rotating disks decrease the frictional forces between the tire and free end of the lever arm thereby avoiding the enveloping of the end of the lever arm by the wide relatively low pressure tires used by present day vehicles. The central section 45 of each lever arm does contact the surface of the vehicle tire and also shares in supporting the weight thereof. However, the tapering of the sides and top edge portions of the lever arm serves to further reduce the tendency of the tire to grab the end of the lever arm and rotate it in a direction opposite to that of the vehicle movement. In the embodiment shown, the upper most end of the lever arm is shown extended to the outer peripheral portion of the disks 16. However, the lever arm can be made slightly shorter if the lever arm is sufficiently strong so as to support the weight of the vehicle on the disks 16 and axle 20 alone. In addition, the disks can be increased in width to assume more of the applied force.

Figure 4:
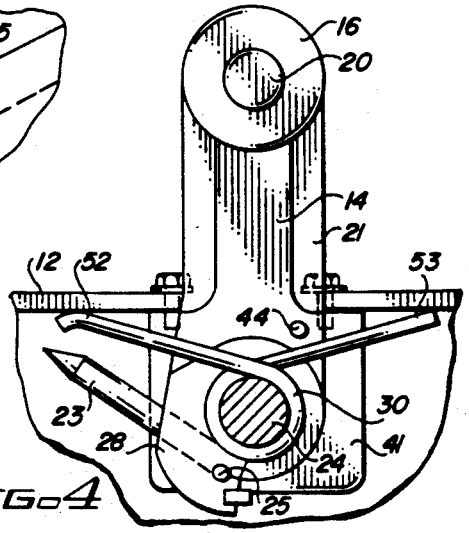
FIG. 4 is a view taken as indicated by line 4—4 of FIG. 3.
Figure 3:
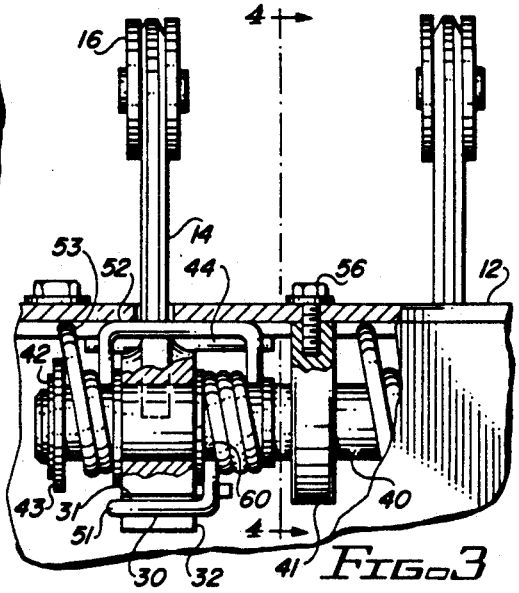
FIG. 3 is an enlarged sectional view of one lever arm and its coupling means.

The manner of rotation of the lever arms 14 is more readily understood from FIGS. 3 and 4, wherein shaft 24 is shown extending transversely beneath plate 12. A plurality of bearing blocks 41 are spaced therebeneath to provide support for the shaft 40 and are held in position by bolts 56 accessible from the top surface of plate 12. The second or opposing end 32 of the lever arms is provided with an opening through which shaft 40 extends. As noted in FIG. 3, the end of the shaft is provided with a retaining clip 42 and a retention washer 43 to limit lateral movement of the lever arm on the shaft. Each lever arm is provided with a double wound spring member 30 which urges the lever to return to an upright position regardless of which direction that a vehicle has crossed the plate 12. The spring has a first end 51 which is received in a groove 31 and wrapped about the shaft. It also extends in a generally U-shaped central section 52 to the opposite side of the lever arm and is then wrapped about the shaft on the other side of the lever. The second end 53 of the spring extends upwardly and resides against the bottom surface of plate 12. The two spring sections wrapped about the shaft 40 on either side of central section 52 are in opposing directions so that the lever is continually returned to its upright position as shown in FIG. 1.

The position of the spring 30 in its normal operating position is shown in FIG. 4 wherein the lever arm 14 extends vertically through the opening in plate 12. The disks 16 mounted for rotation on axle 20 are then positioned to contact a vehicle tire. The tapered edge portion of the lever arm shown as region 21 is an extension of the tapered top edge 46 and extends along the length of the lever until terminating just beneath the plate 12. As mentioned previously, the taper extends across the top of the lever arm so that the vehicle tire encountering a particular lever arm contacts primarily the rotatable disks 16. The second end of the lever arm is mounted on shaft 24 for rotation with the spring central portion 52 and second end 53 resting against the underside of the plate 12. The spike or piercing member 23 is held by retaining pin 25 in a receiving socket 28. This permits the retaining pin 25 to be driven out and the spike to be removed from the socket and replaced if it is broken off during use. Transverse pin 44 preferably does not engage the adjacent second end 53 of spring 30 so that a degree of movement is permitted in the lever arm in the upright position as shown. This pin extends through the central portion of the lever arm as shown in FIG. 3. Pin 44 serves to engage the adjacent portion of the spring member when the lever arm is moved by a vehicle travelling in the non-permitted direction.

Figure 5:
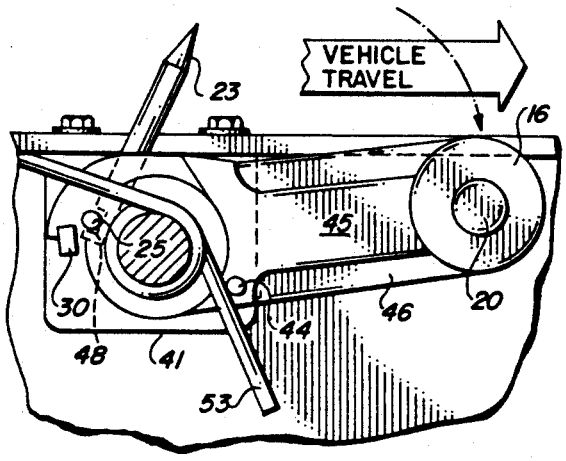
FIG. 5 is a view similar to FIG. 4 with a vehicle travelling in the non-permitted direction as shown by the arrow.

The non-permitted direction of vehicle travel is shown by the arrow in FIG. 5. For vehicle movement in this direction the resultant movement of the lever arm is to a position beneath the top surface of plate 12. The emergence of the piercing member 23 from beneath the plate to a position where it engages and harms the vehicle tire is shown. As the lever arm 14 is urged in the direction shown by the arrow, the pin 44 engages the second end 53 of the spring and is urged thereagainst deflecting this end of the spring in the manner shown. The rotational mounting of the disks on the ends of each lever arm enable the disks to rotate along the surface of the tire as it moves in the direction of the arrow. The envelopment of the exposed end of the lever arm by the vehicle tire, which is characteristic of traffic controllers now in use, does not take place with the result that there is no significant force tending to drive the lever arm in the counterclockwise direction. In the prior art devices, the tire frictionally engages and grabs the lever arm moving it in the direction of travel of the vehicle tire. This reaction is contrary to the intended result. In such cases, the piercing member never emerges from beneath plate 12, no damage to the tire takes place and the general population begins to ignore the traffic controller. The present invention has been found to essentially eliminate this problem by reducing the frictional forces between the free end of the lever arm and the vehicle tire.

Figure 6:
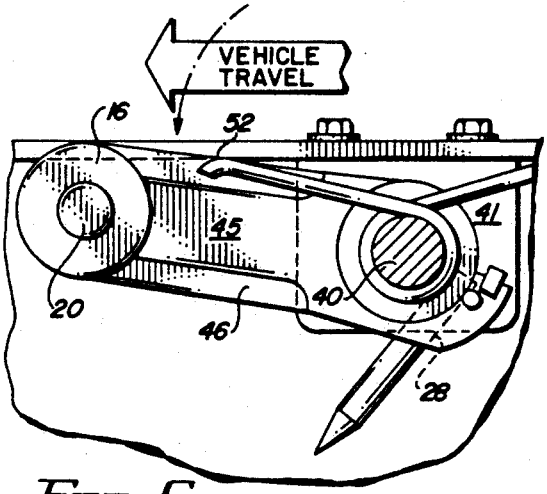
FIG. 6 is a view similar to FIG.4 showing the movement of the lever arm and associated spike for vehicle movement in the permitted direction.

The operation of the device in the permitted direction is shown in FIG. 6 wherein the free end of the lever arm is contacted by the tire of the vehicle travelling in the direction of the arrow. In this circumstance, the vehicle is working against the central portion 52 of the spring and urges the lever down as shown with the piercing member safely moved out of the way. As noted previously, FIG. 6 shows the typical reaction to a vehicle moving in the non-permitted direction obtained with those previous devices utilizing a static or fixed lever arm end.

The present invention includes several features that are significant to the ease of assembly and costs of manufacture. In particular, the use of a single spring to provide the opposing restoring forces enables the assembly to be made in a remote location by spacing the parts along the shaft and loosely attaching the bolts 56 while maintaining the appropriate spacing of the spring members. The use of positioning clips 60, such as E-rings, on the shaft with corresponding receiving grooves on the shaft position the device on the shaft. The tightening of the bolts maintains the proper alignment of the springs in position against the underside of the plate 12. Furthermore, the provision of a receiving socket with a retaining pin enables a piercing member or spike to be removed and replaced without disassembling the entire apparatus. As shown in FIG. 5, each spike is provided with a notch 48 for receiving the retaining pin 25 which is accommodated in a suitable bored hole in the second end of each lever arm 14. In addition, the central portions of the openings 15 in plate 12 need not be expanded to permit movement of the lever arm through the plate since the region of expanded thickness is located at the very end of the lever arm. Thus, no significant hazard is presented to members of the public wishing to tamper with the apparatus when installed.

While the above description has referred to a specific embodiment of the invention, it is to be noted that many modifications and variations may be made therein without departing from the spirit and scope of the invention as claimed.

I claim:

1. Apparatus for allowing vehicle traffic flow in a permitted direction while inhibiting flow in the reverse direction which comprises:

a) a planar member for supporting motor vehicles traveling thereacross, said member having a plurality of openings spaced thereacross;

b) a plurality of actuating levers, each lever having a first end extending upwardly through one of said openings and positioned to contact a vehicle tire passing across the planar member;

c) coupling means located beneath said planar member for rotationally mounting said levers to permit movement in the directions of said traffic flow, said levers moving to a position beneath said planar member when contacted by a vehicle tire;

d) contacting means rotationally mounted on the first end of said levers and having a circumferential surface for contacting a vehicle tire and moving along the surface thereof; and e) a plurality of piercing members operatively connected to said actuating levers beneath the planar member, said piercing members rotating with the levers to engage a tire when a vehicle is moving in the reverse direction.

2. The invention in accordance with claim 1 wherein said contacting means includes at least one disk rotationally mounted on said first end.

3. The invention in accordance with claim 2 wherein said contacting means includes a pair of disks rotationally mounted on said first end.

4. The invention in accordance with claim 3 further comprising an axle located in said first end with said disks mounted thereon.

5. The invention in accordance with claim 4 wherein said axle is disposed generally perpendicular to the opposing direction.

6. The invention in accordance with claim 5 wherein the first end is aligned with the circumferential surface of the disks mounted on said axle.

7. The invention in accordance with claim 2 further comprising biasing means operatively connected to said coupling means for urging said levers to extend upwardly through said openings.

8. The invention in accordance with claim 7 wherein said biasing means comprises a plurality of springs, each contacting a corresponding lever.

9. The invention in accordance with claim 8 wherein said coupling means includes a shaft mounted beneath said planar member proximate to said openings, said levers being rotatably mounted thereon.

10. The invention in accordance with claim 2 wherein each of said lever arms is provided with a receiving socket and each of said piercing members comprises an elongated spike dimensioned to be received in a socket.

11. The invention in accordance with claim 10 further comprising a plurality of retaining pins and wherein each of said lever arms contains a transverse borehole intersecting said socket for receiving a retaining pin, each elongated spike containing a notch for accommodating a retaining pin, the removal of a retaining pin permitting the corresponding spike to be withdrawn from a socket.

12. The invention in accordance with claim 11 wherein said coupling means comprises a shaft having said levers mounted thereon, and a plurality of spring members for biasing said levers in the upwardly extending position.

* * * * *